United States Patent [19]

Obrist et al.

[11] Patent Number: 4,960,370

[45] Date of Patent: Oct. 2, 1990

[54] INTERNAL AXIS ROTARY PISTON MACHINE

[76] Inventors: Frank Obrist, Christophstrasse 24, 6850 Dornbirn, Austria; Felix H. Wankel, deceased, late of Heidelberg, Fed. Rep. of Germany; by Gerhard Renz, executor, Schlo trasse 75, Stuttgart, Fed. Rep. of Germany; by Fried Meysen, executor, Kastellweg 35, Heidelberg, Fed. Rep. of Germany; by Thomas Burkhardt, executor, Rohrbacher Strasse 18, Heidelberg, Fed. Rep. of Germany

[21] Appl. No.: 338,810

[22] Filed: Apr. 14, 1989

[30] Foreign Application Priority Data

Apr. 15, 1988 [AT] Austria ..... 3812637

[51] Int. Cl.[5] ..... F01C 1/30

[52] U.S. Cl. ..... 418/9; 418/166

[58] Field of Search ..... 418/9, 168, 212, 166, 418/171

[56] References Cited

U.S. PATENT DOCUMENTS

| | | | |
|---|---|---|---|
| 2,490,115 | 12/1949 | Clarke | 418/166 |
| 2,531,808 | 11/1950 | Eames | 418/171 |
| 3,244,111 | 4/1966 | Shelhart | 418/212 X |
| 3,474,954 | 10/1969 | Linder | 418/166 X |
| 3,551,081 | 12/1970 | Brundage | 418/171 |
| 4,714,417 | 12/1987 | Wankel | 418/166 X |

FOREIGN PATENT DOCUMENTS 2918369 11/1980 Fed. Rep. of Germany ..... 418/168

*Primary Examiner*—Michael Koczo
*Assistant Examiner*—Douglas J. Makosy
*Attorney, Agent, or Firm*—Ladas & Parry

[57] ABSTRACT

The rotary piston machine has two internal rotors (2, 3) fixed to a common shaft (12) and two external rotors (4, 5) rigidly interconnected by means of an annular rotor disk (9). The working spaces (16) between the engagement parts of both external rotors (4, 5) extend a maximum extension (19) radially inward past the inner boundary of rotor disk (9). For the axial sealing of the working spaces (16), also in the area of said extension (19), the rotor disk (9) encloses a partition body (15), which surrounds the shaft (12) of the internal rotors (2, 3) by means of a bearing (43). A further bearing (13) is provided between rotor disk (9) and partition body (15). Partition body (15) is prevented from concomitant rotation with one of the two rotary machine parts (9, 12) adjacent thereto as a result of the radial displacement of the shaft (12) engaging therein relative to the rotation axis of rotor disk (9). Partition body (15) permits the axial subdivision of the machine into a low pressure part (22) and a high pressure part (23), accompanied by a reinforcement of the engagement parts of the external rotor (4, 5) by its rigid connection to the rotor disk (9).

10 Claims, 2 Drawing Sheets

INTERNAL AXIS ROTARY PISTON MACHINE

BACKGROUND OF THE INVENTION

1. FIELD OF THE INVENTION:

The invention relates to internal axis rotary piston engines.

2. PRIOR ART:

Engines of this type are generally known, for example, from FIGS. 22 and 27 of U.S. Pat. No. 3,954,355. These machines are constructed in such a way that their external rotors always laterally cover the space surrounded by an axial, inner rotor disk, so that the axially adjacent working spaces are sealed relative to one another. According to FIG. 27 of U.S. Pat. No. 3,954,355, the gear driving connection is arranged between an internal rotor pair and an external rotor pair in the space enclosed by the rotor disk. However, where there is to be a radial support between two axially adjacent external rotors, there is an axial, inner partition rigidly connected to the machine casing, in which is mounted the shaft of the internal rotor and which radially supports two circular ring-like, axial, inner external rotor disks by means of a cylindrical inner body shaped thereon. However, such a partition prevents the direct axial connection between two external rotors via a circular ring-like rotor disk and leads to a more complicated casing construction.

SUMMARY OF THE INVENTION

The present provides a multiple stage rotary piston machine or which, in the case of simple casing construction, provides a reinforcing connection between several external rotors or the subdivision of an external rotor, and, moreover, permits the spaces to extend radially inward past the maximum possible radial inner boundary of the rotor disk for the external so that the machine has an increased throughput volume. The radial inner boundary of the rotor disk is constructionally limited by the necessary radially displaced arrangement of the internal rotor shaft relative to the rotation axis of the external rotors.

According to the invention, the aforementioned problem is solved in that the space enclosed by the rotor disk is filled by a partition body and between the rotor disk and the partition body, as well as between the latter and the shaft, is provided in each case a bearing and the working spaces of the machine operate on the partition body.

As a result of the above, the partition body is not connected to any stationary part and although it is only adjacent to rotating parts, i.e., it surrounds the rotating shaft and is, in turn, surrounded by the rotating rotor disk, it is itself stationary. This is due to the radial displacement of the axes of said two bearings, i.e., the axes of rotation of the shaft and the rotor disk.

BRIEF DESCRIPTION OF THE DRAWINGS

The novel features characteristic of the invention, are set forth in the appended claims. The invention itself, however, as well as other features and advantages thereof will best be understood by reference to the following detailed description of a non-limitative embodiment when read in conjunction with the accompanying drawings, wherein:

DETAILED DESCRIPTION

Figure 1:
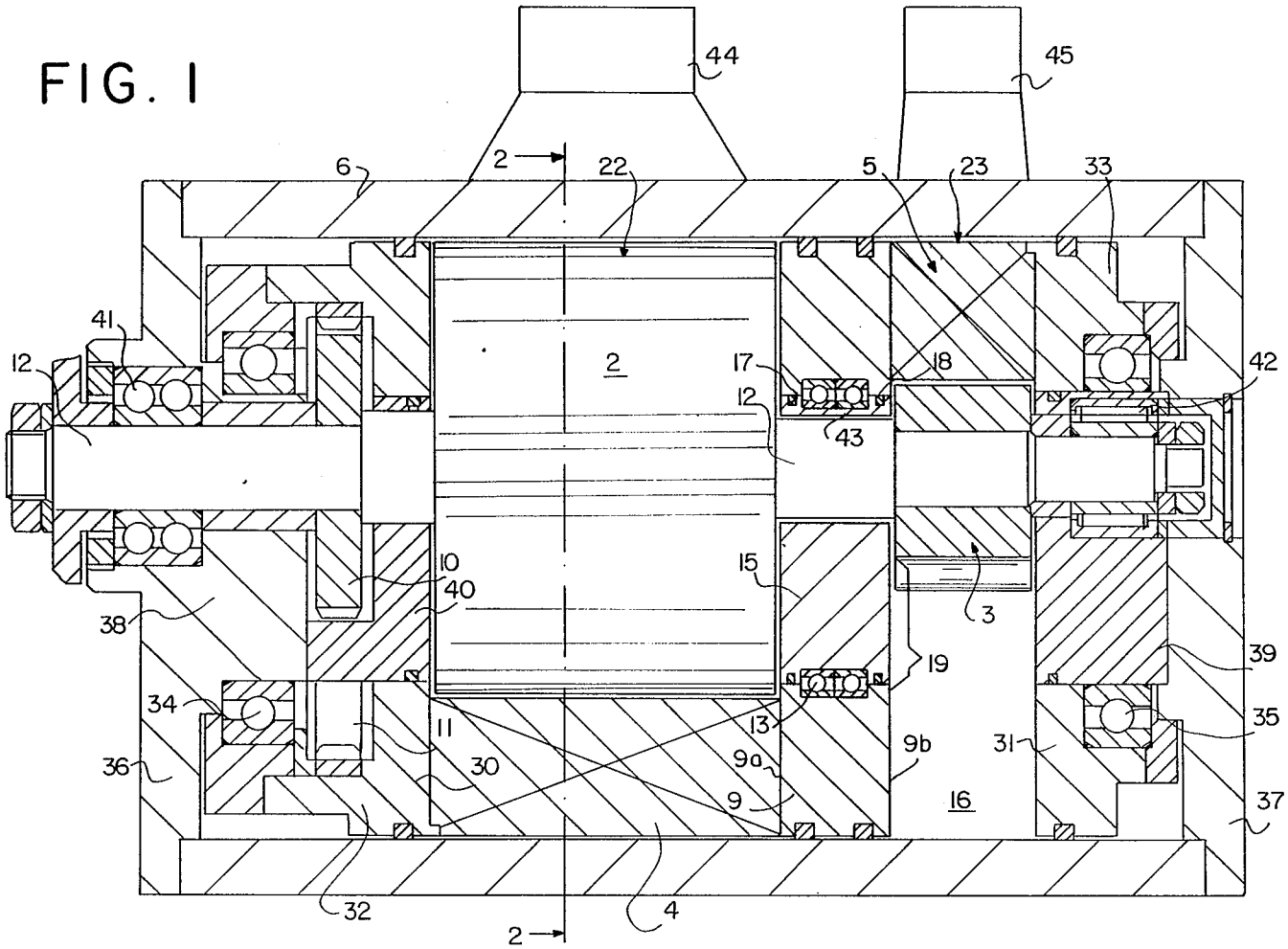
FIG. 1 is a diagram of an axial section through the inventive internal axis rotary piston machine.

According to the principle of rotary piston machines, the internal rotors 2, 3 rotate about an axis 7 and the external rotors 4, 5 rotate about another axis 8 (see FIG. 2) both axes being fixed relative to common machine casing 6. Very high rotational speeds are possible. External rotor 4 has three engagement parts 4*a*, 4*b*, 4*c*, which, as a result of their axial constant cross-section, can be easily manufactured from rod material with a relatively large axial length. As a result of the bending loads due to centrifugal forces, the free axial length of the engagement parts 4*a*, 4*b*, 4*c* is limited by a rotor disk 9 rigidly interconnecting engagement parts 4*a*, 4*b*, 4*c* in the circumferential direction. The rigid connection is preferably brought about by a one-piece manufacture of engagement parts 4*a*, 4*b*, 4*c* and rotor disk 9.

The second external rotor also has three engagement parts 5*a*, 5*b*, 5*c*, of which only one is visible in the drawings (FIG. 1). Engagement parts 5*a*, 5*b*, 5*c* are axially connected on the opposite side of rotor disk 9 from engagement parts 4*a*, 4*b*, 4*c* of the first external rotor 4. Thus, the engagement parts can be coaxially connected thereto, so that the rotor disk 9 merely constitutes an interruption of the axial path of the engagement parts. However, to provide for a more uniform operation of the machine and a lower loading of the driving connection between the external and internal rotors via gears 10, 11, the axially adjacent external and internal rotors 2 to 5 are preferably circumferentially displaced by 180 degrees with respect to each other, as shown in FIG. 1. The load peaks resulting from compression in the machine consequently do not simultaneously occur on both of the axially adjacent rotors 2, 3 and 4, 5.

Figure 2:
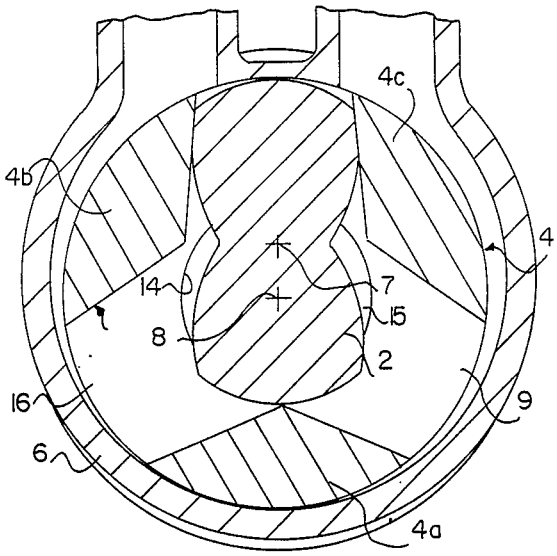
FIG. 2 is a diagram of a radial section through the rotary piston machine according to FIG. 1, along line II—II.

The size of the internal diameter 14 of the rotor disk 9 is determined by the eccentricity of shaft axis 7 of internal rotors 2, 3 relative to the rotation axis 8 of external rotors 4, 5, best visible in FIG. 2, as well as the external diameter of shaft 12 of internal rotors 2, 3 in the vicinity of rotor disk 9. Account must also be made for the arrangement of a bearing 13 on internal diameter 14, to reduce the frictional resistance between a partition body 15, which is surrounded by rotor disk 9 and which remains stationary relative to the machine casing 6 as rotor disk 9 and shaft 12 rotate. Bearing 13 is preferably constructed as a roller bearing. In the represented embodiment, bearing 13 is enclosed in circumferential grooves in the rotor disk 9 and in the partition body 15, so that bearing 13 is sealed from the working spaces 16 of the machine. It should be apparent to those skilled in the art that bearing 13 need only be provided in a single circumferential groove which can be provided in either rotor disk 9 or partition body 15. Axial sealing of the annular clearance between rotor disk 9 and partition body 15 can be provided either by close dimensioning the clearance space or by utilizing ring gaskets 17, 18 in the clearance space, which gaskets may be disposed in grooves as depicted in FIG. 1.

Figure 3:
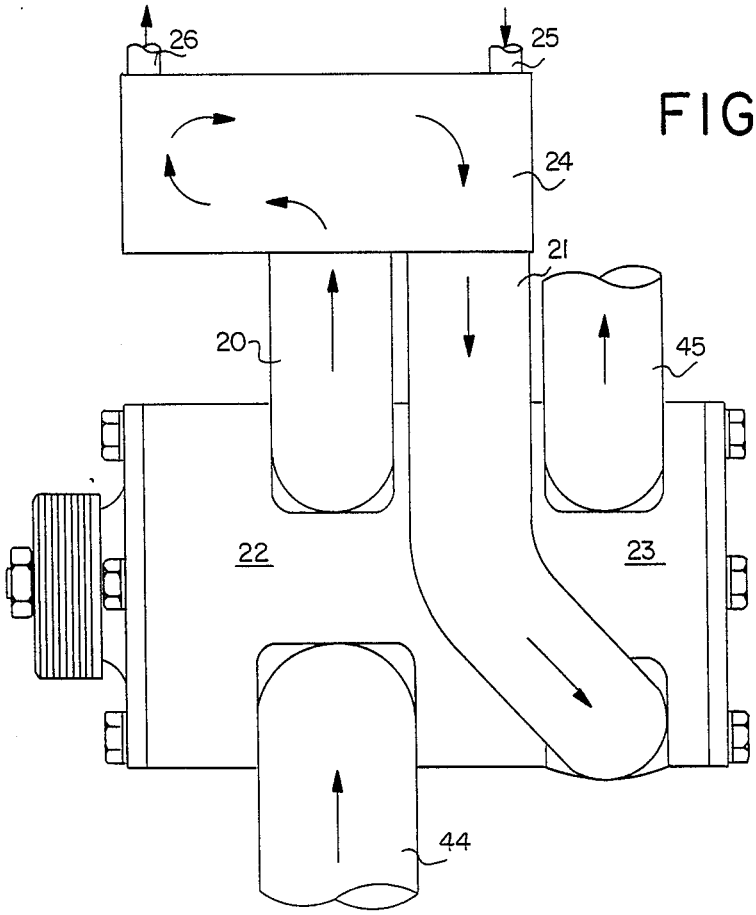
FIG. 3 is a planar view of the inventive rotary piston machine operating in two-stage manners.

As indicated by numeral 19 on FIG. 1 and also apparent from FIG. 2, the working spaces 16 of the rotary piston machine extend radially inward substantially over and beyond the internal diameter 14 of the inner rotor disk 9 and are bounded in such extension area 19 on one side by partition body 15, which extends in the same plane as the rotor disk 9 and consequently provides a radial inner extension of its lateral faces 9a, 9b bounding the working spaces 16. Through the combination of the axial inner rotor disk 9 and the axial inner partition body 15, the machine working spaces 16 are subdivided into two axially separated working areas which are, in this case, a high pressure stage 23 following a low pressure stage 22. FIG. 3 shows the flow ducts 20, 21 between the low pressure stage 22 and the high pressure stage 23 of the rotary piston machine, which are fed via an intermediate cooler 24, so that the gases heated in the compression in the low pressure stage 22 are cooled prior to further compression by the high pressure stage 23. The coolant circulates via pipes 25, 26.

The basic operation of the represented embodiment, particularly the shape of the working spaces 16 between engagement parts 4a, 4b, 4c varying dynamically through the relative movement between the external and internal rotors is described and shown in greater detail in German Patent No. 34 32 915, the disclosure of which is hereby incorporated herein by this reference.

On their two outer ends, the external rotor unit formed by the two external rotors 4, 5 carries annular end bodies 30, 31, which are screwed to the engagement parts 4a, 4b, 4c; 5a, 5b, 5c, as indicated by lines 32, 33. End bodies 32, 33 are used for mounting the external rotor unit 4, 5 by means of roller bearings 34, 35, which are supported on support bodies 38, 39 fixed to casing end plates 36, 37. The gear driving connection provided by gears 10, 11 between the external rotor unit 4, 5 and internal rotor unit 2, 3 has a gear ratio of 2:3, and gear 10 is arranged between an internal body 40 and support body 38, which bodies 38, 40 are firmly screwed to one another. Shaft 12 of the internal rotor unit 2, 3 is mounted in roller bearings 41, 42, which are held in support body 38 at one end of the rotary machine and in support body 39 at the other end.

The bearing 43 between the axial inner partition body 15 and shaft 12 is less stressed, because the bearing forces occurring there only have to prevent the concomitant rotation of the partition body 15 with the axial inner rotor disk 9. Therefore, this bearing can be formed by a thin bearing box 43.

The machine inlet pipe connection 44 and outlet pipe connection 45 are located on the circumference of casing 6.

Having described the invention with respect to one embodiment thereof, modification may now suggest itself to those skilled in the art. The invention itself is not to be limited to the disclosed embodiment, except as required by the appended claims.

We claim:

1. An internal axis rotor piston machine comprising:

(a) a common shaft;

(b) at least two internal rotors fixed to said common shaft;

(c) external rotors corresponding in number to said internal rotors, and defined by annular end bodies (30, 31) in the axial direction;

(d) a common casing enclosing said internal rotors and said external rotors;

(e) said external rotors having engagement parts rigidly and circumferentially connected to one another, said internal rotors having engagement parts interacting with said engagement parts of said external rotors.

(f) at least one rotor disk axially connecting each said external rotor, to an adjacent external rotor, said rotor disk having an annular space and so disposed as to surround said common shaft;

(g) a partition body situated in said annular space between the rotor disk and said common shaft; and (h) working spaces formed between the engaging parts of the external rotors and respectively between the rotor disk (9) and annular end bodies (30, 31), and further defined by said inner rotors as they depend from their rotary position, said working spaces extending up to said partition body.

2. The internal axial rotary piston machine as claimed in claim 1, wherein said inner rotor disk and said partition body subdivide the machine into an axially longer low pressure stage and an axially shorter high pressure stage, said parts interconnected by means of a flow duct running outside said common casing.

3. The internal axial rotary piston machine as claimed in claim 1, wherein bearings are disposed between said rotor disk and said partition body.

4. The internal axial rotary piston machine as claimed in claim 3, wherein said bearings are disposed in a groove arranged in at least one of said rotor disk and said partition body.

5. An internal axial rotary piston machine as claimed in claim 3, wherein a roller bearing is located between said rotor disk and said partition body and a slide bearing is positioned between said common shaft and said partition body.

6. An internal axial rotary piston machine as claimed in claim 3, wherein said axially adjacent external rotors, are fixed to one another in a circumferentially displaced manner and the axially adjacent internal rotors are fixed to one another in said circumferentially displaced manner.

7. An internal axial rotary piston machine as claimed in claim 6, wherein the displacement is 180 degrees.

8. The internal axial rotary piston machine as claimed in claim 3, wherein said rotor disk and said partition body subdivide the machine into an axially longer low pressure stage and an axially shorter high pressure stage, said parts interconnected by means of a flow duct running outside said common casing.

9. An internal axial rotary piston machine as claimed in claim 1, wherein said axially adjacent external rotors are fixed to one another in a circumferentially displaced manner and the axially adjacent internal rotors are fixed to one another in said circumferentially displaced manner.

10. An internal axial rotary piston machine as claimed in claim 9, wherein the displacement is 180 degrees.

* * * * *